US005962140A

United States Patent [19]

Rajagopalan

[11] Patent Number: 5,962,140

[45] **Date of Patent: *Oct. 5, 1999**

[54] GOLF BALL COMPRISING FLUOROPOLYMER

[75] Inventor: Murali Rajagopalan, South Dartmouth, Mass.

[73] Assignee: Acushnet Company, Fairhaven, Mass.

[ * ] Notice: This patent is subject to a terminal disclaimer.

[21] Appl. No.: 08/971,029

[22] Filed: Nov. 14, 1997

Related U.S. Application Data

[63] Continuation-in-part of application No. 08/668,652, Jun. 25, 1996, Pat. No. 5,691,066.

[51] Int. Cl.[6] ..... A63B 57/00; C08F 214/18; C08L 27/12; C08L 33/02

[52] U.S. Cl. ..... 428/421; 428/422; 473/357; 473/371; 473/372; 473/373; 473/374; 473/377; 473/378; 473/385; 525/196; 525/199; 525/200; 525/221; 525/327.8; 525/330.2; 525/919; 526/243; 526/295; 526/247

[58] Field of Search ..... 428/421, 422; 473/351, 385, 356, 378, 357, 361, 371, 372, 373, 374, 376, 377; 526/243, 244, 245, 247, 248; 525/196, 199, 200, 221, 327.8, 330.2, 919

[56] References Cited

U.S. PATENT DOCUMENTS

| | | | |
|---|---|---|---|
| 3,041,317 | 6/1962 | Gibbs et al. | 260/79.3 |
| 3,264,272 | 8/1966 | Rees | 260/78.5 |
| 3,282,875 | 11/1966 | Connolly et al. | 260/29.6 |
| 3,454,280 | 7/1969 | Harrison et al. | 273/235 |
| 3,624,053 | 11/1971 | Gibbs et al. | 260/79.3 R |
| 3,819,768 | 6/1974 | Molitor | 260/897 B |
| 3,882,093 | 5/1975 | Cavanaugh et al. | 260/79.3 |
| 3,992,014 | 11/1976 | Retford | 273/218 |
| 4,323,247 | 4/1982 | Keches et al. | 273/235 R |
| 4,431,193 | 2/1984 | Nesbitt | 273/235 R |
| 4,486,319 | 12/1984 | Jamison | 252/12.2 |
| 4,508,309 | 4/1985 | Brown | 249/81 |
| 4,526,375 | 7/1985 | Nakade | 273/235 R |
| 4,674,751 | 6/1987 | Molitor et al. | 273/235 R |
| 4,884,814 | 12/1989 | Sullivan | 273/235 R |
| 4,911,451 | 3/1990 | Sullivan et al. | 273/235 R |
| 5,150,905 | 9/1992 | Yuki et al. | 273/218 |
| 5,197,740 | 3/1993 | Pocklington et al. | 273/235 R |
| 5,324,783 | 6/1994 | Sullivan | 525/196 |
| 5,409,233 | 4/1995 | Kennedy | 273/235 A |
| 5,625,003 | 4/1997 | Kato et al. | 524/208 |
| 5,691,066 | 11/1997 | Rajagopalan | 428/421 |
| 5,783,293 | 7/1998 | Lammi | 428/212 |

FOREIGN PATENT DOCUMENTS

| | | |
|---|---|---|
| 2-159285 | 6/1990 | Japan . |

*Primary Examiner*—Vivian Chen
*Attorney, Agent, or Firm*—Pennie & Edmonds LLP

[57] ABSTRACT

A golf ball having a core and/or an intermediate layer comprising a functionalized fluoropolymer wherein the fluoropolymer may be a perfluoropolymer that is sulfonated or carboxylated or a derivative thereof. The fluoropolymer material may be blended with conventional materials employed to form golf ball cores, intermediate layers, and/or covers.

34 Claims, No Drawings

GOLF BALL COMPRISING FLUOROPOLYMER

CROSS REFERENCE TO RELATED APPLICATION

This application is a Continuation-In-Part of U.S. patent application Ser. No. 08/668,652 filed Jun. 25, 1996 now U.S. Pat. U.S. Pat. No. 5,691,066.

FIELD OF THE INVENTION

The invention relates to golf balls and, more particularly, to golf balls having covers, coatings or cores which comprise fluoropolymers and to methods for making the same. Golf balls produced in accordance with the present invention are characterized by improved properties including abrasion-resistance, cut resistance, and durability.

BACKGROUND OF THE INVENTION

Golf balls have undergone extensive evolution designed to improve their play-related characteristics, such as durability, distance, and control. Modern golf balls can be classified as one-piece, two-piece, and three-piece balls.

One-piece balls are formed from a homogeneous mass of material with a dimple pattern molded therein. One-piece balls are inexpensive and durable, but do not provide great distance because of relatively high spin and low velocity.

Two-piece balls are the most popular type of ball in use today. They comprise a cover molded around a solid core. Conventionally, both two-piece and three-piece golf balls are made by molding a cover about the ball core, either by injection-molding cover stock material around a core held in a retractable pin mold or by compression molding preformed half-shells about the core. The preformed half-shells are formed by injecting cover stock material into half-shell molds and solidifying the cover stock material into a corresponding shape. Golf ball cores, whether wound or solid, typically measure from 1.4 to 1.6 inches (3.5 to 4.1 cm) in diameter. The cover is molded about the core to form a golf ball having the minimum United States Golf Association (USGA) specified diameter of 1.68 inches (4.3 cm). Typically, the cover has a thickness of about 0.060 inches. Two-piece balls typically have a hard "cutproof" cover which gives a longer distance ball, but which has lower spin rates, resulting in a decreased ability to control the ball.

Three-piece or wound balls are made by molding a cover about a wound center. The center is typically made of rubber and can be solid, semi-solid or fluid, e.g., liquid-filled. A wound center is prepared by winding a thin thread of elastic material about the center. The wound center is then covered with a durable cover material. Wound balls are generally softer and provide more spin, resulting in increased control over the ball, but such balls typically travel a shorter distance than that traveled by a two-piece ball. As a result of their more complex construction, wound balls generally are more expensive to produce than two-piece balls.

The covers of golf balls are generally made from a variety of materials, such as balata or ionomer resins such as SURLYN® and IOTEK®. Balata, which is a natural or synthetic trans-polyisoprene rubber, is the softest of these cover materials. Balata covered balls are favored by the more highly skilled golfers because the softness of the cover allows the player to achieve spin rates sufficient to more precisely control ball direction and distance, particularly on shorter shots.

However, balata covered balls are expensive and less durable as compared to the other covering materials. In particular, balata covered balls are subject to nicks or cuts as a result of a mis-swung golf club or due to landing on cart paths, etc. and/or contact with rocks, trees, etc. Such nicks or cuts detract from the flight characteristics of such balls, rendering them of little use. Accordingly, cover compositions have been developed in an attempt to provide balls with spin rates and a feel approaching those of balata covered balls, while also providing a golf ball with a higher durability and overall distance.

Ionomer resins have, to a large extent, replaced balata as a cover stock material. Chemically, ionomer resins are a copolymer of an olefin and an alpha, beta ethylenically-unsaturated carboxylic acid having 10–90% of the carboxylic acid groups neutralized by a metal ion. See U.S. Pat. No. 3,264,272. Commercially available ionomer resins include, for example, copolymers of ethylene and methacrylic or acrylic acid. These are sold by E.I. DuPont de Nemours and Co. under the trademark "SURLYN®" and by the Exxon Corporation under the trademark "ESCOR®" and the trademark "IOTEK®". These ionomer resins are distinguished by the type of metal ion, the amount of acid, and the degree of neutralization. Also, Chevron Chemical Co. sells a family of ionomers produced from ethylene acrylate-based copolymers under the trademark "IMAC®".

U.S. Pat. Nos. 3,454,280, 3,819,768, 4,323,247, 4,526,375, 4,884,814, and 4,911,451 all relate to the use of SURLYN®-type compositions in golf ball covers. However, while SURLYN® covered golf balls as described in the preceding patents possess virtually cutproof covers, they have inferior spin and feel properties as compared to balata covered balls.

In 1986, DuPont introduced two new classes of ionomer resins. One was a sodium and zinc ionomer resin having a low flexural modulus. DuPont suggested using and blending the same with other ionomer resins for making a golf ball cover. Golf ball covers made from these low flexural modulus ionomer resins have improved spin and feel characteristics but relatively low velocity. The other was a lithium ionomer resin which was a copolymer of ethylene and methacrylic acid. These lithium ionomer resins have a very high flexural modulus, typically about 60,000 psi (415 MPa). DuPont suggested that lithium ionomer resins could be used to produce a golf ball cover which would be more cut resistant and harder than a cover made with either sodium or zinc ionomer resins. DuPont also suggested that a golf ball having a cover made from a lithium ionomer resin would go farther, have a higher coefficient of restitution and be less prone to cutting (i.e., more durable) than a golf ball made from other known ionomer resins such as sodium and zinc ionomer resins and blends thereof. DuPont further suggested that lithium ionomer resins could be used in blends with other ionomer resins where they can impart better cut resistance to those other resins.

The USGA has promulgated a rule that no golf ball shall have an initial velocity that exceeds 255 feet (78 m) per second, i.e., 250 feet (76 m) per second with a 2% tolerance when impacted by the USGA test machine under specified conditions. Golf balls with covers made from ionomer resins with a low flexural modulus are woefully below this maximum and, as should be appreciated, all golf ball manufacturers strive to come as close as possible to this limit.

In various attempts to produce an ideal golf ball, the golfing industry has blended hard ionomer resins (i.e., those ionomer resins having a hardness of about 60 to about 70 on the Shore D scale as measured in accordance with ASTM method D-2240) with a number of softer polymeric materials, such as softer polyurethanes (see, e.g., U.S. Pat. No. 4,674,751 to Molitor et al.). However, the blends of the hard ionomer resins with the softer polymeric materials have generally been unsatisfactory in that these balls exhibit numerous processing problems. In addition, the balls produced by such a combination are usually short on distance.

In addition, various hard-soft ionomer blends, that is, mixtures of ionomer resins which are significantly different in hardness and/or flexural modulus, have been attempted. U.S. Pat. No. 4,884,814 discloses the blending of various hard methacrylic based ionomer resins with similar or larger quantities of one or more "soft" ionomer methacrylic acid based ionomer resins (i.e., those ionomer resins having a hardness from about 25 to 40 as measured on the Shore D scale) to produce relatively low modulus golf ball cover compositions that are not only softer than the prior art hard ionomer covers but also exhibit a sufficient degree of durability for repetitive play. These relatively low modulus cover compositions were generally comprised of from about 25 to 70% of hard ionomer resins and from about 30 to 75% of soft ionomer resins.

U.S. Pat. No. 5,324,783 discloses golf ball cover compositions comprising a blend of a relatively large amount, e.g., 70–90 wt. %, of hard ionomer resins with a relatively low amount, e.g., 10 to about 25–30 wt. %, of soft ionomers. The hard ionomers are sodium or zinc salts of a copolymer of an olefin having from 2 to 8 carbon atoms and an unsaturated monocarboxylic acid having from 3 to 8 carbon atoms. The soft ionomer is a sodium or a zinc salt of a terpolymer of an olefin having from 2 to 8 carbon atoms, methacrylic acid and an unsaturated monomer of the acrylate ester class having from 1 to 21 carbon atoms.

In order to approximate the characteristics of balata covered balls at lower cost, the art has developed balls having a variety of cover compositions. There are more than fifty commercial grades of ionomers available from DuPont and Exxon with a wide range of properties which vary according to the type and amount of metal cations, molecular weight, composition of the base resin (i.e., relative content of ethylene and methacrylic and/or acrylic acid groups) and additive ingredients such as reinforcements, etc. As noted above, these prior art compositions have a considerably higher cut resistance and durability as compared to balata covered balls. A great deal of research continues in order to develop golf ball cover compositions exhibiting not only improved impact resistance and carrying distance properties produced by the "hard" ionomeric resins, but also the playability (i.e. "spin") characteristics previously associated with the "soft" balata covers, properties which are still desired by the more skilled golfer.

Finishing coats of paints are often applied to the molded surface of the golf ball in order to obtain a desired whiteness for the ball and to protect logos and/or trademarks appearing on the surface of the golf ball cover materials. The abrasion and cut resistance of such coatings is typically adjusted by adding filler materials, by using a harder resin, that is, one having a higher glass transition temperature (Tg), by employing a slip and mar agent, and/or by increasing the crosslink density of the polymer.

U.S. Pat. No. 3,992,014 teaches that solid particulate filler materials, for instance 1–50% based on weight of rubber polymer, can be included in the formulation as needed or desired to impart specific properties to the molded article. For example, for golf ball applications, such filler materials as zinc oxide, magnesium oxide, silica, hydrated silica such as HiSil 233, carbon black, lithium oxide, and the like, can advantageously be used to improve the scratch and abrasion resistance of the composition. The '014 patent also teaches the inclusion of a silane in a homogeneous golf ball composition which is based on a cross-linked rubber polymer for the purpose of improving the velocity of such golf balls.

U.S. Pat. No. 4,486,319 teaches that the lower the Melt Flow Index of the coating polymer, the higher the abrasion resistance of the composition. The '319 patent also teaches that ionomers do have abrasion resistance, which makes them useful for such items as golf ball covers.

U.S. Pat. No. 5,197,740 teaches that Surlyn containing covers are highly advantageous in that the resulting covers are extremely resistant to cuts and abrasion. These balls are commonly referred to in golfing circles as cutless balls. However, the '740 patent also enumerates problems with the Surlyn balls: while extremely advantageous from the standpoint of cut resistance, the golf balls described in U.S. Pat. No. 3,454,280 have a shortcoming in that they do not have cold temperature cracking properties such as to permit their use at temperatures below freezing.

In fact, when such balls are played at temperatures below freezing, they have a tendency to crack or explode when struck by a golf club. Likewise, balls produced according to the patent are lacking in their coefficient of restitution, a property related to the distance which a golf ball can be driven.

U.S. Pat. No. 5,409,233 teaches that coatings which are prepared using hexamethylene diisocyanate-based products show resistance to chemicals and abrasion. The '233 patent also teaches the use of mar and slip agents.

None of the prior art patents teach a solution to the continuing problem of providing a golf ball with an industry acceptable coating suitable for use under rigorous conditions. In view of the problem caused by the cutting, scratching, and abrasion of the covers of golf balls, there exists a need for golf ball covers and coatings that are capable of providing improved cut and abrasion resistance and adherence without adversely affecting overall golf ball performance characteristics.

Relatively recently, a number of golf ball manufacturers have introduced multilayer golf balls, i.e., balls with multiple core layers, multiple intermediate or mantle layers and/or multiple cover layers, in an effort to overcome some of the undesirable aspects of conventional two-piece balls such as their hard feel, while maintaining the positive attributes of these balls such as their increased initial velocity and distance. The physical characteristics of the cover layer and the various intermediate layers will vary depending upon the construction as well as the selection of the materials for such layers.

Multilayer golf balls can be formed using a variety of constructions. For example, multilayer balls may have two or more cover layers molded around a conventional core. Alternatively, they may comprise a conventional cover and a core with one or more intermediate layers interposed between the cover and the core. Likewise, multilayer balls may be formed from cores having more than one core layer and may optionally contain one or more intermediate and/or cover layers. Multilayer balls may even comprise a conventional wound core around which at least one intermediate layer and/or at least one cover layer is formed. Typically, one or more of the layers is softer in relation to the other layers. Examples of multilayer balls include the Episode (Titleist), Altus Newing (Bridgestone), Giga (Spalding), Metal Mix (Dunlop) and Ultra Tour Balata (Wilson).

Golf ball cores are commonly formed from base elastomers such as polybutadiene, natural rubber, styrene butadiene rubber, and polyisoprene. Typically, golf ball cores are predominantly made of polybutadiene. In order to obtain the desired physical properties for golf balls, manufacturers have added cross-linking agents, such as metallic salts of an unsaturated carboxylic acid to the polybutadiene. The amount of cross-linking agent added is typically about 20 to 50 parts per hundred parts of polybutadiene. Most commonly, zinc diacrylate or zinc dimethacrylate are used for this purpose of these two cross-linkers, zinc diacrylate has been found to produce golf balls with greater initial velocity than zinc dimethacrylate.

As used herein, "pph" refers to parts per hundred parts of the base elastomer. Typically, about 5 to 50 pph (parts per hundred) of zinc oxide (ZnO) is also added to the composition. This material serves as both a filler and an activation agent for the zinc diacrylate/peroxide cure system. The zinc diacrylate/peroxide cure system, which is well known to those of ordinary skill in this art, cross- links the polybutadiene during the core molding process. The high specific gravity of zinc oxide (5.57) can serve the dual purposes of adjusting the weight of the golf ball, in addition to acting as an activation agent.

SUMMARY OF THE INVENTION

The invention is directed to a golf ball comprising a fluoropolymer. While the fluoropolymer will generally be used in forming some or all of the cover of the golf ball, it may also or alternatively comprise some or all of the core, and/or an intermediate layer(s). In accordance with the invention, the fluoropolymer comprises from 1 to 100% by weight of the core, intermediate layer and/or cover of the golf ball.

In particular, the present invention is directed to a golf ball core, intermediate layer(s), and/or cover layer comprising a fluoropolymer resin, for instance a functionalized fluoropolymer resin that is sulfonated, carboxylated, epoxidized, maleated, amined or hydroxylized.

More particularly, the present invention is directed, in a first embodiment, towards golf balls comprising at least a cover and a core wherein the cover is formed from compositions comprising at least one fluoropolymer resin. Preferably, such compositions contain a second component which is compatible with the fluoropolymer resin such as a polyurethane, epoxy resin, polyethylene, polyamide, polyester or acid copolymers or their ionomer derivatives or blends thereof.

The present invention is further directed in a second embodiment towards golf balls comprising a cover, a core and at least one intermediate layer interposed between the cover and the core, wherein the intermediate layer is formed from a composition comprising at least one fluoropolymer resin. As with the cover layers, such compositions preferably contain a second component such as a polyurethane, epoxy resin, polyethylene, polyamide, polyester or acid copolymers or their ionomer derivatives or blends thereof.

The present invention is yet further directed in a third embodiment towards a golf ball comprising a cover, a core and at least one intermediate layer interposed between the cover and the core, wherein both the cover and at least one intermediate layer are both formed from a composition comprising at least one fluoropolymer resin.

Additionally, the present invention is yet further directed in a fourth embodiment towards a golf ball comprising at least a cover and a core, and optionally one or more intermediate layers interposed between the cover and the core, wherein the core is formed from a composition comprising at least one fluoropolymer resin. Optionally, the cover and/or the intermediate layer(s) may also be formed from a composition comprising at least one fluorpolymer resin.

In the golf ball cover of the present invention, the fluoropolymer resin preferably comprises from 10 to 90% by weight of the cover while 90 to 10 weight-% of the cover is comprised of one or more conventional, non-fluorinated ionomeric and/or non-ionomeric thermoplastic polymers.

The invention includes one-piece golf balls comprising a fluoropolymer as well as two-piece and three-piece golf balls comprising at least one cover layer and a core, wherein at least one cover layer comprises a fluoropolymer, as well as golf balls that comprise cores or covers having two or more layers.

The present invention also provides a method of enhancing the cut and abrasion resistance of a golf ball. The method comprises the steps of forming a golf ball core by conventional means and subsequently forming a cover around the core by either compression molding preformed half-shells of cover stock material comprising a fluoropolymer about the core or by injection molding cover stock material comprising a fluoropolymer about the core. Golf balls that are manufactured in this manner will have cut and abrasion resistance superior to otherwise similar golf balls without fluoropolymer in their covers.

Further in accordance with the present invention, the fluoropolymer used to manufacture the golf ball may be blended with at least one additional thermoplastic ionomer and/or with at least one non-ionomeric thermoplastic resin.

The novel golf ball of the present invention offers improved mechanical properties in comparison to golf balls disclosed in the prior art, for instance, improved abrasion-resistance, cut-resistance, and durability. Further these balls may also provide enhanced distance (i.e., resilience) without adversely affecting, and in many instances while improving, their "playability" characteristics, i.e., their impact resistance, spin, "click" and "feel", compression, etc.

DESCRIPTION OF THE PREFERRED EMBODIMENTS

Broadly, the present invention contemplates a golf ball comprising a fluoropolymer. The ball may be a one-piece ball formed from a homogeneous mass consisting entirely of fluoropolymer, or including blends of conventional golf ball cover materials, such as those discussed hereinbelow, with fluoropolymers. One-piece balls will generally have a dimple pattern molded therein. One-piece balls in accordance with the present invention are quite durable, but do not provide great distance because of relatively high spin and low velocity.

A more preferred aspect of the present invention comprises two-piece, multilayer and/or wound balls having cores, intermediate layers and/or covers comprising a functionalized fluoropolymer of the type disclosed herein.

The Fluoropolymers

A fluoropolymer is generally an olefinic polymer in which monomers containing units of the formula —(H)C=C(H)—, wherein one or more of the hydrogen atoms in the monomer is replaced by fluorine atoms, are reacted with identical monomers or, more usually, one or more different monomers to form a polymer. Preferably, the fluoropolymer is a perfluoropolymer. That is, all of the available hydrogens are replaced by fluorines. Also preferably, the fluoropolymer is functionalized. That is, the polymer contains reactive groups such as sulfonyl, carboxyl, epoxy, maleate, amine or hydroxyl groups, in a degree sufficient to affect the properties of the polymer.

In accordance with the present invention, the fluoropolymer preferably has the formula

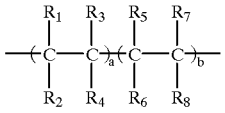

in which a is an integer from 1 to 100, b is an integer from 99 to 1, $R_1$–$R_7$ are independently selected from the group consisting of H, F, alkyl (preferably $C_1$–$C_4$ alkyl), and aryl, and $R_8$ is H, F, or a moiety of the formula

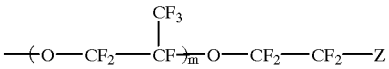

in which m is an integer from 1 to 18 and Z is selected from the group consisting of $SO_2F$, $SO_3H$, $SO_3^-M^{v+}$, COF, $CO_2H$, and $CO_2^-M^{v+}$, Hydroxyl (OH);

epoxy

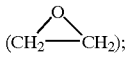

amines ($NR_{14}R_{15}$);

quaternized amines

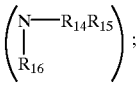

maleated compounds

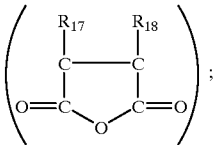

half ester compounds

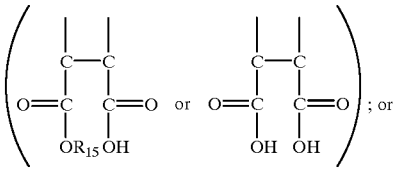

full ester compounds

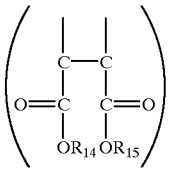

wherein v is the valence of M and M is a cation selected from Group I, Ia, IIa, IIb, IIIa, IIIb, IVa, IVb, and transition elements and wherein $R_{14}$=$R_{15}$=H or lower alkyl; $R_{16}$=H, lower alkyl or aromatic; $R_{17}$=$R_{18}$=H or lower alkyl.

In an alternate preferred embodiment, the fluoropolymer for use with the invention can be a terpolymer having the formula

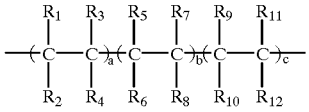

where a, b and $R_1$–$R_8$ are as defined above, C is an integer from 1 to 50, $R_9$–$R_{11}$ are independently selected from the group consisting of H, F, alkyl and aryl, $R_{12}$ is selected from the group consisting of

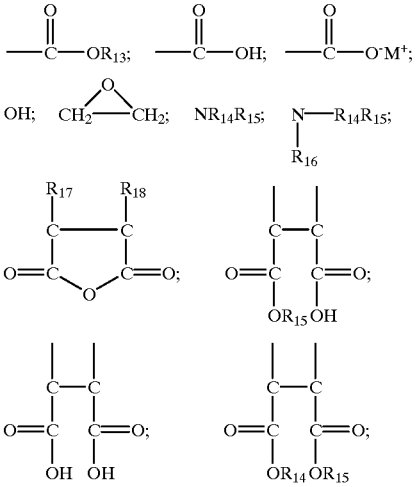

wherein $R_{13}$ is a $C_1$–$C_{12}$ linear or branched chain alkyl group wherein $R_{14}$=$R_{15}$=H or lower alkyl; $R_{16}$=H, lower alkyl or aromatic; and $R_{17}$=$R_{18}$=H or lower alkyl More preferably, the fluoropolymer used in the invention has the formula

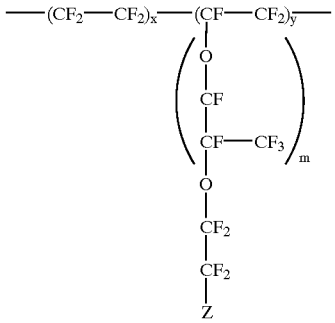

wherein Z is as defined above, x is 1-100, y is 99 to 1, and m is an integer from 1 to 12, more preferably from 7 to 10.

Such fluoropolymers may be prepared by copolymerizing a compound of the structure $$CF_2{=}CFOCF_2CF(CF_3)OCF_2CF_2Z$$

or, more broadly, vinyl ethers of the structures $$CF_2{=}CF(X)_nOCF_2CFRZ$$

and/or $$CF_2{=}CF(X)_nOCF(Z)CF_2R$$

wherein X is $O(CF_2)_{2-10}$, $OCF_2CFY$, or $OCFYCF_2$, Y is F or $CF_3$, and Z is as defined above. In these formulas, R is F or a perfluoroalkyl group having up to 10 carbon atoms, and n is 0, 1, or 2. These vinyl ethers are copolymerized with perfluoroethylene and/or perfluoro-α-olefins. These polymers are useful in molecular weights ranging from 1000 to 500,000. Such polymers are disclosed in U.S. Pat. Nos. 3,041,317, 3,282,875, and 3,624,053, the disclosures of which are expressly incorporated by reference herein. Some of the sulfonated polymers are commercially available from DuPont under the trademark NAFION®.

Other polymers which may be used in accordance with the present invention to form golf balls include polymers containing molecular units of the structure $$-CF_2\overset{|}{C}F(X)_nOCF_2CFRZ \quad \text{or} \quad -CF_2\overset{|}{C}F(X)_nO\overset{CF_2R}{\overset{|}{C}}FZ$$

wherein X, Z, R, and n are as defined above. Such polymers may be prepared by polymerizing the vinyl ethers described above, optionally in a perfluorocarbon solvent, using a perfluorinated free radical initiator such as perfluoroperoxide or a nitrogen fluoride. It is also possible to polymerize the vinyl ethers in aqueous medium using a peroxide or a redox initiator. Preparations of these fluoropolymers are disclosed in U.S. Pat. Nos. 3,282,875 and 3,882,093, also incorporated herein by reference thereto.

Another preferred group of fluoropolymers for use in accordance with the present invention is those of the formula $$-(OCF_2CF(CF_3))_mOCF2CF_2Z$$

wherein Z is as defined above and m is a number from 7 to 10. Fluoropolymers in which m is from 7 to 10 provide golf ball covers with greater resiliency and therefore better distance characteristics.

The fluoropolymers of the present invention can be synthesized by a variety of methods since it is well known in the art of polymer synthesis that many different synthetic protocols can be used to prepare a given compound. Different routes can involve more or less expensive reagents, easier or more difficult separation or purification procedures, straightforward or cumbersome scale-up, and higher or lower yield. The skilled synthetic organic polymer chemist knows well how to balance the competing characteristics of synthetic strategies. Thus the compounds of the present invention are not limited by the choice of synthetic strategy, and any synthetic strategy that yields the compounds described above can be used. However, since such polymers are commercially available, for instance from DuPont under the trademark NAFION® as discussed above, there will often be no need to synthesize them.

Cover and Intermediate Layer Compositions

In accordance with the present invention, the fluoropolymer comprises from 1 to 100% by weight of the golf ball cover composition and/or the intermediate layer composition. Unless otherwise stated herein, all percentages are given in percent by weight of the total composition. Preferably, the fluoropolymer comprises from about 10 to about 90%, more preferably from about 10 to about 75 and most preferably from about 15 to about 40 of the cover composition and/or the intermediate layer composition. About 90 to 10%, more preferably from about 90 to about 25 and most preferably from about 85 to about 60 of the cover and/or the intermediate layer composition is comprised of one or more other non-fluorinated polymers such as, but not limited to ionomers, polyurethanes, epoxy resins, polyethylenes, polyamides and polyesters.

For example, such additional polymers may include ionomers such as the SURLYN®, ESCOR®, IOTEK®, and IMAC® copolymers described above. Such ionomers are obtained by providing thermolabile ionic crosslinking to polymers of monoolefin with at least one member selected from the group consisting of unsaturated mono- or di-carboxylic acids having 3 to 12 carbon atoms and esters thereof (the polymer contains 1 to 50% by weight of the unsaturated mono- or di-carboxylic acid and/or ester thereof). More particularly, such acid-containing ethylene copolymer ionomer component includes E/X/Y copolymers where E is ethylene, X is a softening comonomer such as acrylate or methacrylate present in 0–50 (preferably 0–25, most preferably 0–20), weight percent of the polymer, and Y is acrylic or methacrylic acid present in 5–35 (preferably 10–35, more preferably at least about 16–35, most preferably at least about 16–20) weight percent of the polymer, wherein the acid moiety is neutralized 1–90% (preferably at least 40%, most preferably at least about 60%) to form an ionomer by a cation such as lithium, sodium, potassium, magnesium, calcium, barium, lead, tin, zinc or aluminum, or a combination of such cations. Specific acid-containing ethylene copolymers include ethylene/acrylic acid, ethylene/methacrylic acid, ethylene/acrylic acid/n-butyl acrylate, ethylene/methacrylic acid/n-butyl acrylate, ethylene/methacrylic acid/iso-butyl acrylate, ethylene/acrylic acid/iso-butyl acrylate, ethylene/methacrylic acid/n-butyl methacrylate, ethylene/acrylic acid/methyl methacrylate, ethylene/acrylic acid/methyl acrylate, ethylene/methacrylic acid/methyl acrylate, ethylene/methacrylic acid/methyl methacrylate, and ethylene/acrylic acid/n-butyl methacrylate. Preferred acid-containing ethylene copolymers include ethylene/methacrylic acid, ethylene/acrylic acid, ethylene/methacrylic acid/n-butyl acrylate, ethylene/acrylic acid/n-butyl acrylate, ethylene/methacrylic acid/methyl acrylate and ethylene/acrylic acid/methyl acrylate copolymers. The most preferred acid-containing ethylene copolymers are ethylene/methacrylic acid, ethylene/acrylic acid, ethylene/(meth)acrylic acid/n-butyl acrylate, ethylene/(meth)acrylic acid/ethyl acrylate, and ethylene/(meth)acrylic acid/methyl acrylate copolymers.

The manner in which the ionomers are made is well known in the art as described in, e.g., U.S. Pat. No. 3,262,272.

As mentioned above, other suitable materials for forming the cover and/or intermediate layers, i.e., for use in combination with fluoropolymer compounds, include polyurethanes, epoxy resins, polyethylenes, polyamides and polyesters. For example, the cover and/or intermediate layer may be formed from a blend of at least one fluoropolymer compound and thermoplastic or thermoset urethanes/polyurethanes, urethane ionomers and urethane epoxies and blends thereof. Examples of suitable urethane ionomers are disclosed in co-pending U.S. patent application Ser. No. 08/482,519, filed Jun. 7, 1995, entitled "Golf Ball Covers", the disclosure of which is hereby incorporated by reference in its entirety in the present application.

Polyurethane is a product of a reaction between a polyurethane prepolymer and a curing agent. The polyurethane prepolymer is a product formed by a reaction between a polyol and a diisocyanate. The curing agent is typically either a diamine or glycol. Often a catalyst is employed to promote the reaction between the curing agent and the polyurethane prepolymer.

Conventionally, thermoset polyurethanes are prepared using a diisocyanate, such as 2,4-toluene diisocyanate (TDI) or methylenebis-(4-cyclohexyl isocyanate) (HMDI) and a polyol which is cured with a polyamine, such as methylene dianiline (MDA), or a trifunctional glycol, such as trimethylol propane, or tetrafunctional glycol, such as N,N,N',N'-tetrakis(2-hydroxpropyl)ethylenediamine. However, the present invention is not limited to just these specific types of polyurethanes.

Among the suitable thermoplastic polyurethanes are block copolyurethanes which typically contain blocks of a polyurethane oligomer (material with the higher softening point) alternating with lower softening point blocks of either a polyether oligomer, for a block copoly(ether-urethane), a polyester oligomer for a block copoly(ester-urethane) or a polybutadiene or hydrogenated polybutadiene oligomer for a block copoly(butadiene-urethane). The polyether oligomer is typically a polyether macroglycol, such as polytetramethylene ether glycol. The polybutadiene oligomer is a dihydroxy terminated polybutadiene oligomer, which may optionally be partially or fully hydrogenated. The polyurethane block typically consists of 4,4'-diphenylmethane diisocyanate, toluene diisocyanate (any combination of the 2,4- and 2,6- isomers) or para-phenylene diisocyanate, all chain extended with an aliphatic diol, typically 1,4-butanediol. Examples of suitable commercially available thermoplastic polyurethanes include the ESTANE® series from the B.F. Goodrich Company, which includes ESTANE® 58133, 58134, 58144 and 58311; the PELLETHANE® series from Dow Chemical, which includes PELLETHANE® 2102-90A and 2103-70A; ELASTOLLAN® from BASF; DESMOPAN® and TEXIN® from Bayer; and Q-THANE® from Morton International.

The cover and/or intermediate layers may also be formed of a blend of at least one oxa acid compound and a polyamide. Among the polyamide components useful in forming the blends of this invention are nylons. The polyamide component can be comprised of a homopolymer, a copolymer, a block copolymer or a blend of two or more variations of any types of polyamides.

Polyamide homopolymers and copolymers are produced by two common methods. In the first, a compound containing one organic acid-type end group and one amine end group is formed into a cyclic monomer. The polyamide is then formed from the monomer by a ring-opening addition polymerization. These polyamides are commonly designated as nylon 6, nylon 11, nylon 12, etc., where the number indicates the number of carbon atoms making up the ring in the monomer. The second method involves the condensation polymerization of a dibasic acid and a diamine. These polyamides are commonly designated as nylon 4,6, nylon 6,6, nylon 6,9, nylon 6,10, nylon 6,12, etc., where the first number indicates the number of carbon atoms connecting the two amine groups in the diamine and the second number indicates the number of carbon atoms connecting the two acid groups in the dibasic acid, including those in the acid groups. Additionally, polyamide copolymers are produced by blending two or more polyamide melts and holding the materials in the molten state for a sufficient time period such that partial or full randomization occurs. Polyamide copolymers are commonly designated by separating the symbols for the homopolymers by the symbol "/". For the purposes of this application, the component named first can be either the major or a minor component of the copolymer.

Preferred polyamide homopolymers and copolymers include nylon 4, nylon 6, nylon 7, nylon 11, nylon 12, nylon 13, nylon 4,6, nylon 6,6, nylon 6,9, nylon 6,10, nylon 6,12, nylon 12,12, nylon 13,13 and mixtures thereof. More preferred polyamide homopolymers include nylon 6, nylon 11, nylon 12, nylon 4,6, nylon 6,6, nylon 6,9, nylon 6,10, nylon 6,12 and mixtures thereof.

Block polyamide copolymers are materials which contain main-chain blocks or segments of polyamide or copolyamide separated by main-chain blocks of a different polymer. The separating polymer block may be a polyether, such as a poly(alkylene oxide). When poly(ethylene oxide) is used as the separating polymer block, this material is a copolyetheramide block copolymer known commercially as PEBAX®, available from Elf-Atochem, or Arnitel®, available from DSM.

Epoxy resins suitable for combining with a fluoropolymer for forming the cover and/or intermediate layers are typically formed by the reaction of bisphenol A (b) and epichlorohydrin (a) according to the reaction set forth below:

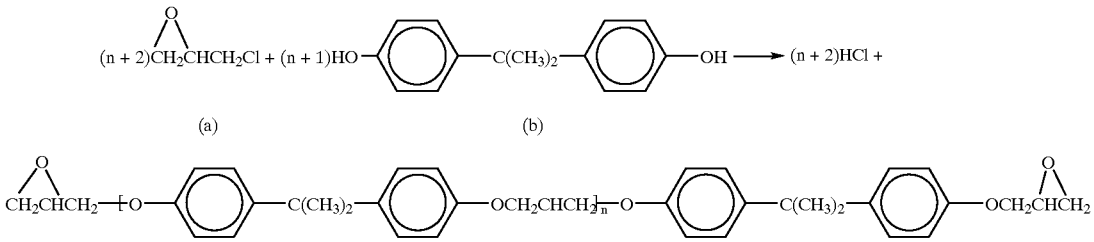

The reaction actually involves the sodium salt of bisphenol A since the polymerization is carried out in the presence of an equivalent of sodium hydroxide. The typical reaction temperatures are in the range of 50–95° C.

Either liquid or solid prepolymers can be produced by control of molecular weight, e.g., "n" less than 1 for liquid prepolymers and "n" in the range of 2–30 for solid preploymers. The epichlorohydrin can be reacted with a variety of hydroxyl, carboxyl and amine compounds to form monomers with two or more epoxide groups.

A generic representation of the structure of suitable epoxy resins is described below

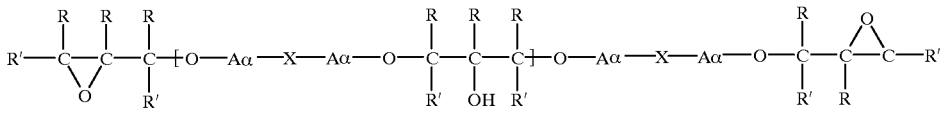

Wherein:

$R_1R^1$=H or $C_nH_{2n+1}$ where n=1–6

Aα=cyclic or aromatic and may contain substituted derivatives such as acids and salts

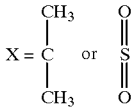

Examples of suitable commercially available epoxy resins include but are not limited to "Epon" resins available from Shell, and "Novolac" resins from Dow.

Suitable polyethylenes for forming the cover and/or intermediate layer include homo and copolymers of ethylene containing functional groups such as maleic anhydride, carboxylic acid and hydroxyl groups. For example, these functional groups are introduced by either chemical grafting as in the case of grafting maleic anhydride such as that sold commercially under the tradename "FUSABOND" by DuPont (Canada). Additionally, such functional groups can be introduced by copolymerizing the ethylene monomer with an unsaturated carboxylic acid comonomer such as a methacrylic acid sold commercially under the tradename "NUCREL" by DuPont.

Homo and copolymers of polyethylenes employed in the present invention can be produced by well known free radical and ionic polymerization methods, including those employing a metallocene based catalyst. A general representation of the structure of copolymers of ethylenes suitable for the present invention is:

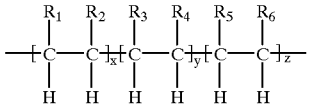

Wherein:

X=0 to 100;

Y=1 to 50;

z=1 to 30;

$R_1$, $R_2$, $R_3$, and $R_5$ are hydrogen or $C_nH_{2n+1}$ wherein n=1 to 5;

$R_4$ and $R_6$ are hydrogen or $C_nH_{2n+1}$ wherein n=1 to 12.

Polyesters suitable for use in the present invention can be produced by direct esterification of a diacid with a diol (as set forth below) or self-condensation of a hydroxy carboxylic acid. For example, a reaction of diacylchloride with a diol(s) at lower temperatures can be used to produce polyesters.

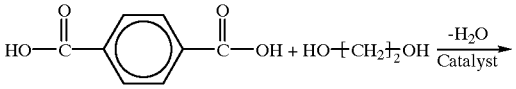

-continued

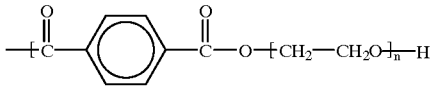

Catalysts such as manganese acetate, antimony oxide and titanium alkoxides are commonly used in the polymerization to produce polyesters. A generic representation of the structure of suitable polyesters is set forth below.

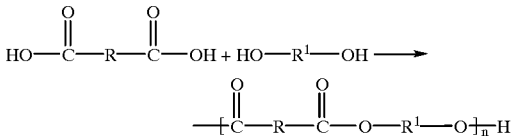

Wherein:

R=substituted and unsubstituted cyclodiphatic or aromatic;

$R^1$=aliphatic or aromatic (e.g. bisphenol-A or bispherol-S); and n>50

Examples of suitable commercially available polyesters include materials sold under the tradenames "Eastpak" PET polyester and "Eastar" PETG from Eastman Chemicals, "Dacron" and "Terglene" from DuPont and PTT (polytrimethylene terephthatate) from Shell just to name a few.

Examples of other specific polymers or families of polymers which can be used in conjunction with the fluoropolymers of the claimed invention in golf ball cover compositions and/or intermediate layer compositions include: poly (ethylethylene), poly(heptylethylene), poly (hexyldecylethylene), poly(isopentylethylene), poly(1,1-dimethyltrimethylene), poly(1,1,2-trimethyltrimethylene), aliphatic polyketones (such as ethylene, carbon monoxide-propylene sold commercially under the tradename "Carilon" by Shell), poly(butyl acrylate), poly(4-cyanobutyl acrylate), poly(2-ethylbutyl acrylate), poly(heptyl acrylate), poly(2-methylbutyl acrylate), poly(3-methylbutyl acrylate), poly (N-octadecylacrylamide), poly(octadecyl methacrylate), poly(butoxyethylene), poly(methoxyethylene), poly (pentyloxyethylene), poly(1,1-dichloroethylene), poly (cyclopentylacetoxyethylene), poly(4-dodecylstyrene), poly (4-tetradecylstyrene), poly(oxyethylethylene), poly (oxytetramethylene), poly(oxytrimethylene), poly (oxycarbonylpentamethylene), poly(oxycarbonyl-3-methylpentamethylene), poly(oxycarbonyl-1,5-dimethylpentamethylene), poly(silanes), poly(silazanes), poly(furan tetracarboxylic acid diimides), and poly (vinylidene fluoride), as well as the classes of polymers to which they belong.

Among the preferred polymers which can be combined with the fluoropolymers of the claimed invention in forming golf ball covers and/or intermediate layers are: block poly (ether-ester) copolymers, such as HYTREL® available from DuPont, block poly(ether-amide) copolymers, such as PEBAX® available from Elf Atochem, partially or fully hydrogenated styrene-butadiene-styrene block copolymers, such as the KRATON D® grades available from Shell Chemical, styrene-(ethylene-propylene)-styrene or styrene-(ethylene-butylene)-styrene block copolymers, such as the KRATON G® series from Shell Chemical, Septon HG-252 from Kurary, either of the KRATON®-type copolymers with maleic anhydride or sulfonic graft or hydroxyl functionality, such as the KRATON FD® or KRATON FG® series available from Shell Chemical, olefinic copolymers, such as the ethylene-methyl acrylate or ethylene-butyl acrylate series available from Quantum Chemical, ethylene-octene copolymers made with metallocene catalysts, such as the AFFINITY® or ENGAGE® series available from Dow, ethylene-alpha olefin copolymers and terpolymers made from metallocene catalysts, such as the EXACT® series available from Exxon, block poly(urethane-ester) or block poly (urethane-ether) or block poly(urethane-caprolactone), such as the ESTANE® series available from BF Goodrich, polyethylene glycol, such as CARBOWAX® available from Union Carbide, polycaprolactone, polycaprolactam, polyesters, such as EKTAR® available from Eastman, polyamides, such as nylon 6 or nylon 6,6, available from DuPont and ICI, ethylene-propylene-(diene monomer) terpolymers and their sulfonated or carboxylated derivatives, and SANTOPRENE® from Monsanto.

The polymer blends of this invention can be prepared with or without the addition of a compatibilizer and with varying molecular architecture of blend components, such as varying molecular weight, tacticity, degrees of blockiness, etc., as is well known to those knowledgeable in the art of blending polymers.

Preferably, the stock used to make a golf ball cover or intermediate layer in accordance with the present invention is a blend of the fluoropolymer resins of the present invention and another polymer. Blending of the polymers is accomplished in a conventional manner using conventional equipment. Good results have been obtained by mixing the polymers or resins in a solid, pelletized form and then placing the mix into a hopper which is used to feed the heated barrel of an injection molding machine. Further mixing is accomplished by a screw in the heated barrel. The injection molding machine is used either to make preformed half-shells for compression molding about a core or for molding flowable cover stock about a core using a retractable-pin mold. Such machines are conventional. Additionally, conventional components which can be added to the cover compositions of the present invention include U.V. stabilizers such as TINUVIN™ 213 and TINUVIN™ 328, for example. Also, light stabilizers such as, for example, TINUVIN™ 770 and TINUVIN™ 765, may also be used. TINUVIN™ products are available from Ciba-Geigy. Dyes, as well as optical brighteners and fluorescent pigments may also be used in the golf ball covers produced with polymers formed according to the present invention. Such additional ingredients may be used in any amounts that will achieve their desired purpose. However conventional amounts include the range of from about 0.05% to about 1.5%, or more preferably, from about 0.5% to about 1.0%.

Effective amounts of white pigment and/or violet agent may also be added if desired to the cover composition. Suitable violet agents include PV Fast Violet RL Special and Hostapern Violet RL Extra Strong sold by Hoechst Celanese Corporation; and Violet 23 sold by Sun Chemical Corporation. The amount of violet agent added to the cover composition is preferably about 0.0005% to about 0.002% based on total weight of cover stock. Good results have been obtained with about 0.001% by weight. Preferably, about 3.5% of the white pigment by weight of the total cover composition is used in the cover stock of the present invention.

Ultramarine blue pigments may also be used in golf ball covers formed according to the present invention. Preferably the amount of ultra marine blue pigment used will range from about 0.01% to about 1.0% or more preferably from about 0.4% to about 0.8%.

Suitable white pigments include titanium dioxide, calcium carbonate, zinc oxide and zinc sulfide. These white pigments may be used in any amount which is suitable to provide a uniform white color of the desired brightness to the golf ball covers of the present invention. In particular, these white pigments may be incorporated in amounts of from about 0.001% to about 5.0%. The more preferred range of white pigment is from about 0.2% to about 0.4%.

Other conventional ingredients, e.g., fillers are well known to the person of ordinary skill in the art and may be included in cover and intermediate layer blends of the present invention in amounts effective to achieve their known purpose.

An optional filler component may be chosen to impart additional density to blends of the previously described components. The selection of such filler(s) is dependent upon the type of golf ball desired (i.e., one-piece, two-piece multilayer or wound), as will be more fully detailed below. Generally, the filler will be inorganic, having a density greater than about 2 g/cc, preferably greater than 4 g/cc, and will be present in amounts between 5 and 65 weight percent based on the total weight of the polymer components. Examples of useful fillers include zinc oxide, barium sulfate, lead silicate and tungsten carbide, as well as the other well known corresponding salts and oxides thereof. It is preferred that the filler components be non- reactive with the polymer components described above.

Additional optional additives useful in forming the golf balls of the present invention include acid copolymer waxes (e.g., Allied wax AC143 believed to be an ethylene/16–18% acrylic acid copolymer with a number average molecular weight of 2,040) which assist in preventing reaction between the filler materials (e.g., ZnO) and any acid moiety in the polymer; optical brighteners; surfactants; processing aids; etc.

The present polymers may be blended with any of the additional ingredients noted above, for using any conventional blending technique. For example, the present compounds may be added to a vessel containing pelletized polymer resins and heated to 300° F.–500° F. Thorough mixing of the materials is accomplished by means of a screw in the heated vessel.

Golf Ball Cores

A representative elastomer base composition for forming a golf ball core prepared in accordance with the present invention comprises polybutadiene as the elastomer and, in parts by weight based on 100 parts polybutadiene (pph), 20–50 pph of a metal salt acrylate such as diacrylate, dimethacrylate, or monomethacrylate, preferably zinc diacrylate and up to about 75 pph of at least one fluoropolymer resin.

The polybutadiene preferably has a cis 1,4 content of above about 90% and more preferably above about 96%. Commercial sources of polybutadiene include Shell 1220 manufactured by Shell Chemical, Neocis BR40 manufactured by Enichem Elastomers, and Ubepol BR150 manufactured by Ube Industries, Ltd. If desired, the polybutadiene can also be mixed with other elastomers known in the art, such as natural rubber, styrene butadiene rubber, and/or polyisoprene in order to further modify the properties of the core. When a mixture of elastomers is used, the amounts of other constituents in the core composition are based on 100 parts by weight of the total elastomer mixture.

Metal salt diacrylates, dimethacrylates, and monomethacrylates suitable for use in this invention include those wherein the metal is magnesium, calcium, zinc, aluminum, sodium, lithium or nickel. Zinc diacrylate is preferred, because it has been found to provide golf balls with a high initial velocity in the USGA test. The zinc diacrylate can be of various grades of purity. For the purposes of this invention, the lower the quantity of zinc stearate present in the zinc diacrylate, the higher the zinc diacrylate purity. Zinc diacrylate containing less than about 10% zinc stearate is preferable. More preferable is zinc diacrylate containing about 4–8% zinc stearate. Suitable, commercially available zinc diacrylates include those from Rockland React-Rite and Sartomer. The preferred concentrations of zinc diacrylate that can be used are 20–50 pph based upon 100 pph of polybutadiene or alternately, polybutadiene with a mixture of other elastomers that equal 100 pph.

Free radical initiators are used to promote cross-linking of the metal salt diacrylate, dimethacrylate, or monomethacrylate and the polybutadiene. Suitable free radical initiators for use in the invention include, but are not limited to peroxide compounds, such as dicumyl peroxide, 1,1-di(t-butylperoxy) 3,3,5-trimethyl cyclohexane, a-a bis (t-butylperoxy)diisopropylbenzene, 2,5-dimethyl-2,5 di (t-butylperoxy) hexane, or di-t-butyl peroxide, and mixtures thereof. Other useful initiators would be readily apparent to one of ordinary skill in the art without any need for experimentation. The initiator(s) at 100% activity are preferably added in an amount ranging between about 0.05 and 2.5 pph based upon 100 parts of butadiene, or butadiene mixed with one or more other elastomers. More preferably, the amount of initiator added ranges between about 0.15 and 2 pph and most preferably between about 0.25 and 1.5 pph.

Typical golf ball cores incorporate 5 to 50 pph of zinc oxide in the zinc diacrylate-peroxide cure system that cross-links polybutadiene during the core molding process.

In the present invention, fluoropolymers may be added to blends for such core compositions in any amount which imparts the advantageous properties to the core and/or finished ball discussed herein. A single fluoropolymer resin or a blend of two or more different fluoropolymer resins may be employed in the present invention. The fluoropolymer may be present in an amount of about up to about 75 pph. Preferably, the fluoropolymer is present in an amount of about 1 to about 50 pph. More preferably, the fluoropolymer is present in an amount of about 5 to about 40 pph. Most preferably, the fluoropolymer is present in an amount of about 5 to about 25 pph.

The compositions of the present invention may also include fillers, added to the elastomeric composition to adjust the density and/or specific gravity of the core. As used herein, the term "fillers" includes any compound or composition that can be used to vary the density and/or hardness properties of the subject golf ball core. Fillers useful in the golf ball core according to the present invention include, for example, zinc oxide, barium sulfate, and regrind (which is recycled core molding matrix ground to mesh particle size). The amount and type of filler utilized is governed by the amount and weight of other ingredients in the composition, since a maximum golf ball weight of 1.620 ounces (45.92 gm) has been established by the USGA. Appropriate fillers generally have a specific gravity in the range of from about 2.0 to 5.6.

Antioxidants may also be included in the elastomer cores produced according to the present invention. Antioxidants are compounds which prevent the breakdown of the elastomer. Antioxidants useful in the present invention include, but are not limited to, quinoline type antioxidants, amine type antioxidants, and phenolic type antioxidants.

Other ingredients such as accelerators, e.g. tetra methylthiuram, processing aids, processing oils, plasticizers, dyes and pigments, as well as other additives well known to the skilled artisan may also be used in the present invention in amounts sufficient to achieve the purpose for which they are typically used.

The core compositions of the invention may be produced by forming a mixture comprising polybutadiene, zinc diacrylate, and at least one fluoropolymer resin. In preparing the core blends, when a set of predetermined conditions is met, i.e., time and temperature of mixing, the free radical initiator is added in an amount dependent upon the amounts and relative ratios of the starting components, all of which would be well understood by one of ordinary skill in the art. In particular, as the components are mixed, the resultant shear causes the temperature of the mixture to rise. Peroxide (s) free radical initiator(s) are blended into the mixture for crosslinking purposes in the molding process.

After completion of the mixing, the golf ball core composition is milled and hand prepped or extruded into pieces ("preps") suitable for molding. The milled preps are then compression molded into cores at an elevated temperature. Typically, 160° C. (320° F.) for 15 minutes is suitable for this purpose. These cores can then be used to make finished golf balls by surrounding the cores with mantle and/or cover materials.

The present invention is directed towards not only cores for use in conventional two-piece and wound golf balls, but also to cores for multilayer golf balls as well. In fact, the present invention contemplates that the presently claimed cores can be employed in golf balls of any construction, wherein the construction includes a solid core.

Golf Ball Manufacture

The polymers of the invention can be used to form any type of golf ball. In particular, two-piece golf balls comprising a cover surrounding a core are within the scope of the present invention, as are wound golf balls, in which a liquid, semi-solid, or solid core is surrounded by an elastic synthetic material. The term "solid cores" as used herein refers not only to one piece cores but also to those cores having a separate solid layer beneath the cover and above the core as disclosed in U.S. Pat. No. 4,431,193 (the disclosure of which is incorporated herein), and other multilayer and/or non-wound cores. Any type of golf ball core can be used in the golf balls of the present invention. Preferred cores, however, include some amount of cisbutadiene. The subject polymers may also be used in golf balls having multiple covers and/or multiple cores.

Typically, the covers are formed around the solid or wound cores by either compression molding preformed half-shells of the cover stock material or by injection molding the cover stock about the core. Half-shells are made by injection molding a cover stock into a conventional half-shell mold in a conventional manner. The preferred method is compression molding of preformed half-shells.

In compression molding, the half-shells of the stock material are formed by injection molding the cover stock material into a conventional half-shell mold at 300° F.–520° F. for a short time. The preformed half-shells are then placed about a core and the assembly is introduced into a compression molding machine. The compression molding machine is a hydraulic press having an upper and lower mold plate. As taught by U.S. Pat. No. 4,508,309, such mold plates have half molds, each of which is registered with another half mold in the opposite mold plate. It has been found that a golf ball is formed with a cover in accordance with the present invention when the half-shells are compression molded about a core at about 250 to 400° F. The molded balls are then cooled while still in the mold and finally removed when the cover is hard enough to be handled without deforming.

Alternatively, golf balls can be covered solely with the use of an injection molding technique utilizing an injection molding machine in which the core assembly is placed in a mold cavity. The core assembly is held in place through the use of several retractable pins. Such injection molding machines are well known in the art. The molten cover material is injected into the cavity surrounding the core. As the cover material cools and hardens, the pins retract and the molded ball is ejected from the mold. The balls then undergo conventional finishing operations such as buffing, painting and stamping. This type of cover construction is generally referred to as a one-piece cover.

The present invention can be used in forming golf balls of any desired size. While USGA specifications limit the size of a competition golf ball to more than 1.680 inches in diameter, golf balls of any size can be used for leisure golf play. The preferred diameter of the golf balls is from about 1.680 inches to about 1.800 inches. The more preferred diameter is from about 1.680 inches to about 1.760 inches. A diameter of from about 1.680 inches to about 1.740 inches is most preferred, however diameters anywhere in the range of from 1.70 to about 1.95 inches can be used. Oversize golf balls with diameters above about 1.760 inches to as big as 2.75 inches are also within the scope of the present invention.

All patents cited in the foregoing text are expressly incorporated herein by reference in their entirety.

It will be understood that the claims are intended to cover all changes and modifications of the preferred embodiments of the invention, herein chosen for the purpose of illustration, which do not constitute a departure from the spirit and scope of the invention.

What is claimed is:

1. A golf ball comprising a cover, a core and at least one intermediate layer interposed between the cover and the core, wherein the intermediate layer is formed from a composition comprising at least one fluropolymer, and wherein said fluropolymer has a formula

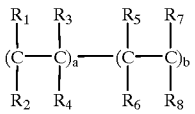

in which a is an integer from 1 to 100; b is an integer from 99 to 1; $R_1$–$R_7$ are independently selected from the group consisting of H, F, alkyl and aryl; and $R_8$ is a moiety of a formula

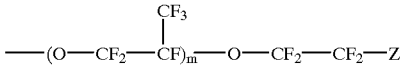

in which m is an integer from 1 to 18; and Z is selected from the group consisting of $SO_2F$, $SO_3H$, $SO_3^-M^{v+}$, COF, $CO_2H$, $CO_2^-M^{v+}$,

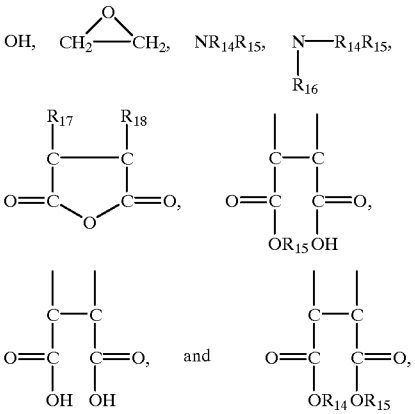

wherein v is the valence of M; M is a cation selected from Group I, Ia, IIa, IIb, IIIa, IIIb, IVa, IVb, and transition elements; $R_{14}$=$R_{15}$=H or lower alkyl; $R_{16}$=H, lower alkyl or aromatic; and $R_{17}$=$R_{18}$=H or lower alkyl.

2. The golf ball of claim 1, wherein the composition further comprises at least one additional component, wherein the at least one component is a compound selected from the group consisting of polyurethanes, epoxy resins, polyethylenes, polyamides, polyesters, acid copolymers or their ionomer derivatives, homo and copolymers of polyethylenes produced employing a metallocene based catalyst, block poly(ether-ester) copolymers, block poly(ether-amide) copolymers, and blends thereof.

3. The golf ball of claim 1, wherein the cover is formed from a composition which comprises at least one fluoropolymer compound.

4. A golf ball comprising a cover, a core and at least one intermediate layer interposed between the cover and the core, wherein the intermediate layer is formed from a composition comprising at least one fluropolymer, and wherein said fluropolymer is a terpolymer having the formula

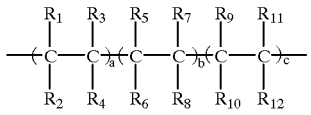

in which a is an integer from 1 to 100; b is an integer from 99 to 1; $R_1$–$R_7$ are independently selected from selected from the group consisting of H, F, aryl; and $R_8$ is a moiety of a formula

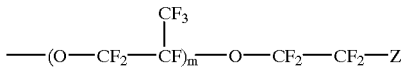

in which m is an integer from 1 to 18; and Z is selected from the group consisting of $SO_2F$, $SO_3H$, $SO_3^-M^{v+}$, COF, $CO_2H$, $CO_2^-M^{v+}$,

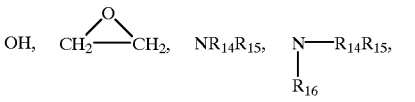

-continued

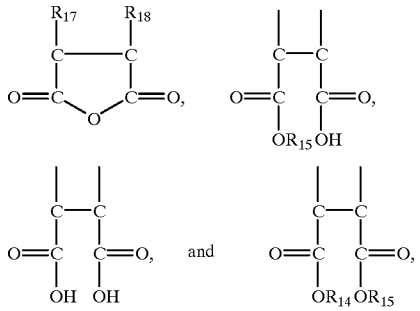

wherein v is the valence of M; M is a cation selected from Group I, Ia, IIa, IIb, IIIa, IIIb, IVa, IVb, and transition elements; $R_{14}$=$R_{15}$=H or lower alkyl; $R_{16}$=H, lower alkyl or aromatic; and $R_{17}$=$R_{18}$=H or lower alkyl; and wherein c is an integer from 1 to 50, $R_9$–$R_{11}$ are independently selected from the group consisting of H, F, alkyl and aryl, and $R_{12}$ is selected from the group consisting of

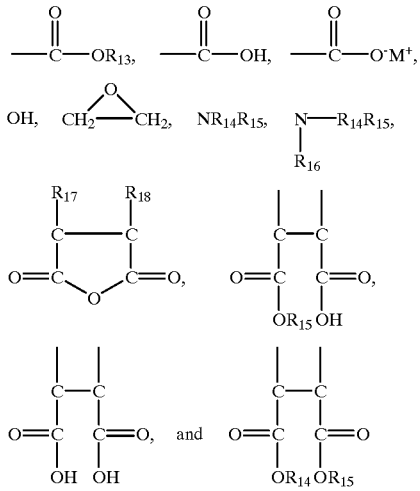

wherein $R_{13}$ is a $C_1$–$C_{12}$ linear or branched chain alkyl group; $R_{14}$=$R_{15}$=H or lower alkyl; $R_{16}$=H or lower alkyl; and $R_{17}$=$R_{18}$=H or lower alkyl.

5. The golf ball of claim 4, wherein the composition further comprises at least one additional component, wherein the at least one component is a compound selected from the group consisting of polyurethanes, epoxy resins, polyethylenes, polyamides, polyesters, acid copolymers or their ionomer derivatives, homo and copolymers of polyethylenes produced employing a metallocene based catalyst, block poly(ether-ester) copolymers, block poly(ether-amide) copolymers, and blends thereof.

6. The golf ball of claim 4, wherein the cover is formed from a composition which comprises at least one fluoropolymer compound.

7. A golf ball comprising a cover, a core and at least one intermediate layer interposed between the cover and the core, wherein the intermediate layer is formed from a composition comprising at least one fluropolymer, and wherein said fluropolymer has a formula

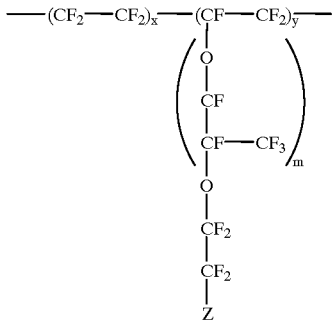

wherein m is 1–12; x is 1–100; y is 99 to 1; and Z is selected from the group consisting of $SO_2F$, $SO_3H$, $SO_3^-M^{v+}$, COF, $CO_2H$, and $CO_2^-M^{v+}$, wherein v is the valence of M; and M is a cation selected from Group I, Ia, IIa, IIb, IIIa, IIIb, IVa, IVb, and transition elements.

8. The golf ball of claim 7, wherein m is an integer from 7 to 10.

9. The golf ball of claim 7, wherein the composition further comprises at least one additional component, wherein the at least one component is a compound selected from the group consisting of polyurethanes, epoxy resins, polyethylenes, polyamides, polyesters, acid copolymers or their ionomer derivatives, homo and copolymers of polyethylenes produced employing a metallocene based catalyst, block poly(ether-ester) copolymers, block poly(ether-amide) copolymers, and blends thereof.

10. The golf ball of claim 7, wherein the cover is formed from a composition which comprises at least one fluoropolymer compound.

11. A golf ball comprising a cover, a core and at least one intermediate layer interposed between the cover and the core, wherein the intermediate layer is formed from a composition comprising at least one fluropolymer, and wherein said fluropolymer is formed by copolymerizing a vinyl ether having a structure selected from the group consisting of $$CF_2{=}CFOCF_2CF(CF_3)OCF_2CF_2Z,$$

$$CF_2{=}CF(X)_nOCF_2CFRZ,$$

and $$CF_2{=}CF(X)_nOCF(Z)CF_2R$$

wherein x is $O(CF_2)_{2\text{-}10}$, $OCF_2CFY$, or $OCFYCF_2$; with Y=F or $CF_3$; Z is selected from the group consisting of $SO_2F$, $SO_3H$, $SO_3^-M^{v+}$, COF, $CO_2H$, and $CO_2^-M^{v+}$, wherein v is the valence of M; M is a cation selected from Group I, Ia, IIa, IIb, IIIa, IIIb, IVa, IVb, and transition elements; R is F or a perfluoroalkyl group having up to 10 carbon atoms; and n is 0, 1, or 2.

12. The golf ball of claim 11, wherein the composition further comprises at least one additional component, wherein the at least one component is a compound selected from the group consisting of polyurethanes, epoxy resins, polyethylenes, polyamides, polyesters, acid copolymers or their ionomer derivatives, homo and copolymers of polyethylenes produced employing a metallocene based catalyst, block poly(ether-ester) copolymers, block poly(ether-amide) copolymers, and blends thereof.

13. The golf ball of claim 11, wherein the cover is formed from a composition which comprises at least one fluoropolymer compound.

14. A golf ball comprising a cover, a core and at least one intermediate layer interposed between the cover and the core, wherein the intermediate layer is formed from a composition comprising at least one fluropolymer, and wherein said fluropolymer has a structure selected from the group consisting of

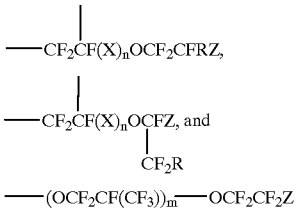

wherein X is $O(CF_2)_{2-10}$, $OCF_2CFY$ or $OCFYCF_2$; Z is selected from the group consisting of $SO_2F$, $SO_3H$, $SO_3^-M^{v+}$, COF, $CO_2H$ and $CO_2^-M^{v+}$, wherein V is the valence of M; M is a cation selected from the group I, Ia, IIa, IIb, IIIa, IIIb, IVa, IVb, and transition elements; R is F or a perfluoroalkyl group having up to 10 carbon atoms; n is 0, 1 or 2; and m is 7–10.

15. The golf ball of claim 14, wherein the composition further comprises at least one additional component, wherein the at least one component is a compound selected from the group consisting of polyurethanes, epoxy resins, polyethylenes, polyamides, polyesters, acid copolymers or their ionomer derivatives, homo and copolymers of polyethylenes produced employing a metallocene based catalyst, block poly(ether-ester) copolymers, block poly(ether-amide) copolymers, and blends thereof.

16. The golf ball of claim 14, wherein the cover is formed from a composition which comprises at least one fluoropolymer compound.

17. A golf ball comprising a cover, a core and at least one intermediate layer interposed between the cover and the core, wherein the intermediate layer is formed from a composition comprising at least one fluropolymer, and wherein said fluropolymer is a perflouropolymer that is sulfonated, carboxylated, epoxidized, maleated, amined or hydroxylized.

18. The golf ball of claim 17, wherein the composition further comprises at least one additional component, wherein the at least one component is a compound selected from the group consisting of polyurethanes, epoxy resins, polyethylenes, polyamides, polyesters, acid copolymers or their ionomer derivatives, homo and copolymers of polyethylenes produced employing a metallocene based catalyst, block poly(ether-ester) copolymers, block poly(ether-amide) copolymers, and blends thereof.

19. The golf ball of claim 17, wherein the cover is formed from a composition which comprises at least one fluoropolymer compound.

20. A golf ball comprising a cover and a core wherein said core is formed from a core blend which comprises at least one fluoropolymer compound, wherein said fluoropolymer has a formula

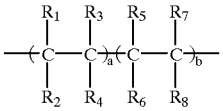

in which a is an integer from 1 to 100; b is an integer from 99 to 1; $R_1$–$R_7$ are independently selected from the group consisting of H, F, alkyl, and aryl; and $R_8$ is a moiety of the formula

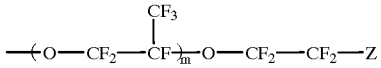

in which m is an integer from 1 to 18; and Z is selected from the group consisting of $SO_2F$, $SO_3H$, $SO_3^-M^{v+}$, COF, $CO_2H$, $CO_2^-M^{v+}$,

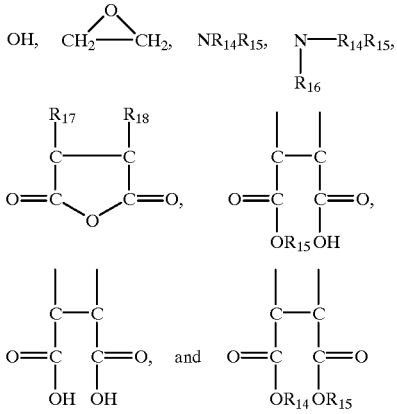

wherein v is the valence of M; M is a cation selected from Group I, Ia, IIa, IIb, IIIa, IIIb, IVa, IVb, and transition elements; $R_{14}$=$R_{15}$=H or lower alkyl; R=H, lower alkyl or aromatic; and $R_{17}$=$R_{18}$=H or lower alkyl.

21. The golf ball of claim 20 wherein said fluoropolymer is a terpolymer having the formula

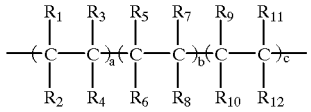

wherein c is an integer from 1 to 50; $R_9$–$R_{11}$ are independently selected from the group consisting of H, F, alkyl and aryl; and $R_{12}$ is selected from the group consisting of

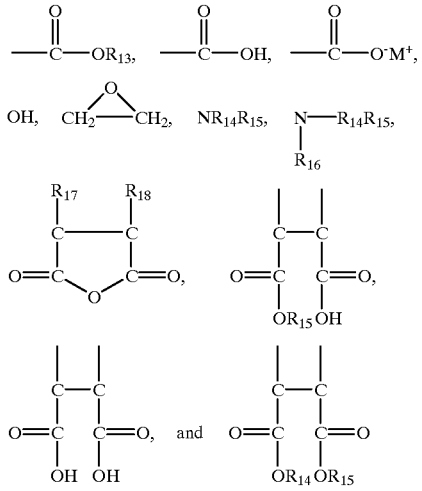

wherein $R_{13}$ is a $C_1$–$C_{12}$ linear or branched chain alkyl group; $R_{14}$=$R_{15}$=H or lower alkyl; $R_{16}$=H, lower alkyl or aromatic; and $R_{17}$=$R_{18}$=H or lower alkyl.

22. The golf ball of claim 20 wherein said fluoropolymer has a formula

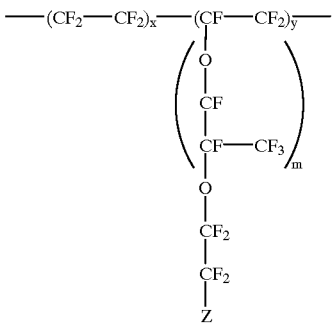

wherein m is 1–12; x is 1–100; y is 99 to 1; and Z is selected from the group consisting of $SO_2F$, $SO_3H$, $SO_3^-M^{v+}$, COF, $CO_2H$, and $CO_2^-M^{v+}$, wherein v is the valence of M; and M is a cation selected from Group I, Ia, IIa, IIb, IIIa, IIIb, IVa, IVb, and transition elements.

23. The golf ball of claim 22 wherein m is an integer from 7 to 10.

24. The golf ball of claim 20 wherein said fluoropolymer is a perfluoropolymer that is sulfonated, carboxylated, epoxidized, maleated, amined or hydroxylized.

25. The golf ball of claim 20, wherein the core blend further comprises an elastomer.

26. The golf ball of claim 25, wherein the fluoropolymer compound is present in the core blend in an amount of up to about 75 parts per hundred parts elastomer.

27. The golf ball of claim 25, wherein the fluoropolymer compound is present in the blend in an amount of about 5 to about 40 parts per hundred parts elastomer.

28. The golf ball of claim 20, wherein the core blend further comprises a polybutadiene and a metal salt acrylate.

29. The golf ball of claim 20, wherein said cover is formed from a blend which comprises a fluoropolymer compound.

30. The golf ball of claim 20 which further comprises at least one intermediate layer disposed between the cover and the core.

31. The golf ball of claim 22, wherein said intermediate layer is formed from a composition which comprises a fluoropolymer compound.

32. The golf ball of claim 20 wherein the golf ball is a wound ball which further comprises a layer of elastic thread disposed between the cover and the core.

33. A golf ball comprising a cover and a core wherein said core is formed from a core blend which comprises at least one fluoropolymer compound, wherein said fluoropolymer is formed by copolymerizing a vinyl ether having a structure selected from the group consisting of $$CF_2{=}CFOCF_2CF(CF_3)OCF_2CF_2Z,$$

$$CF_2{=}CF(X)_nOCF_2CFRZ$$

and $$CF_2{=}CF(X)_nOCF(Z)CF_2R$$

wherein X is $O(CF_2)_{2\text{-}10}$, $OCF_2CFY$, or $OCFYCF_2$; with Y=F or $CF_3$; Z is selected from the group consisting of $SO_2F$, $SO_3H$, $SO_3^-M^{v+}$, COF, $CO_2H$, and $CO_2^-M^{v+}$, wherein v is the valance of M; M is a cation selected from Group I, Ia, IIa, IIb, IIIa, IIIb, IVa, IVb and transition elements; R is F or a perfluoroalkyl group having up to 10 carbon atoms; and n is 0, 1, or 2.

34. The golf ball of claim 33 wherein said fluoropolymer is a perfluoropolymer that is sulfonated, carboxylated, epoxidized, maleated, amined or hydroxylized.

* * * * *

UNITED STATES PATENT AND TRADEMARK OFFICE

CERTIFICATE OF CORRECTION

PATENT NO. : 5,962,140

DATED : October 5, 1999

INVENTOR(S) : Murali Rajagopalan

It is certified that error appears in the above-identified patent and that said Letters Patent is hereby corrected as shown below:

In col. 20, line 50, delete second occurrence of "selected".
In col. 20, line 51, delete "from".
In col. 20, line 51, after "F," add -- alkyl and --.

Signed and Sealed this

Thirteenth Day of June, 2000

*Attest:*

Q. TODD DICKINSON

*Attesting Officer*

*Director of Patents and Trademarks*